US009805661B2

(12) United States Patent
Sun et al.

(10) Patent No.: US 9,805,661 B2
(45) Date of Patent: Oct. 31, 2017

(54) PIXEL COMPENSATION CIRCUIT, DISPLAY DEVICE AND DRIVING METHOD

(71) Applicant: Boe Technology Group Co., Ltd., Beijing (CN)

(72) Inventors: Tuo Sun, Beijing (CN); Zhanjie Ma, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 57 days.

(21) Appl. No.: 14/913,330

(22) PCT Filed: Aug. 20, 2015

(86) PCT No.: PCT/CN2015/087620

§ 371 (c)(1),
(2) Date: Feb. 19, 2016

(87) PCT Pub. No.: WO2016/141680

PCT Pub. Date: Sep. 15, 2016

(65) Prior Publication Data

US 2017/0039954 A1 Feb. 9, 2017

(30) Foreign Application Priority Data

Mar. 11, 2015 (CN) ..... 2015 1 0106550

(51) Int. Cl.
*G09G 3/3291* (2016.01)
*G09G 3/325* (2016.01)
(Continued)

(52) U.S. Cl.
CPC ..... *G09G 3/3291* (2013.01); *G09G 3/325* (2013.01); *G09G 3/3233* (2013.01);
(Continued)

(58) Field of Classification Search
CPC .. G09G 3/3291; G09G 3/3233; G09G 3/3266; G09G 3/325; H03F 3/2171
(Continued)

(56) References Cited

U.S. PATENT DOCUMENTS 5,444,595 A * 8/1995 Ishikawa ..... H03K 17/0822 361/86
5,532,523 A * 7/1996 Tang ..... H02J 9/062 307/64
(Continued)

FOREIGN PATENT DOCUMENTS

CN 102651192 8/2012
CN 102651194 8/2012
(Continued)

OTHER PUBLICATIONS

International Search Report and Written Opinion from PCT/CN15/87620 dated Dec. 16, 2015.
(Continued)

*Primary Examiner* — Fred Tzeng
(74) *Attorney, Agent, or Firm* — Calfee, Halter & Griswold LLP

(57) ABSTRACT

The embodiments of the present invention provide a pixel compensation circuit, a display device and a driving method. The data signal loading module in the pixel compensation circuit loads the data signal to the gate of the driving transistor when the scanning signal is a turn-on signal. The voltage loading module loads the first voltage signal to the source of the driving transistor when the first luminescent signal and the scanning signal are both turn-on signals. The driving signal generation module is used for storing the signal of the source of the driving transistor, the signal of the gate of the driving transistor, the third voltage signal and the voltage signal inputted by the voltage loading module at that
(Continued)

time; and is capable of generating a driving signal for driving the organic light-emitting diode to emit light.

19 Claims, 4 Drawing Sheets

(51) Int. Cl.
*G09G 3/3266* (2016.01)
*G09G 3/3233* (2016.01)

(52) U.S. Cl.
CPC ..... *G09G 3/3266* (2013.01); *G09G 2300/043* (2013.01); *G09G 2300/0819* (2013.01); *G09G 2300/0852* (2013.01); *G09G 2300/0861* (2013.01); *G09G 2310/08* (2013.01); *G09G 2320/0233* (2013.01)

(58) Field of Classification Search
USPC ..... 345/691
See application file for complete search history.

(56) References Cited

U.S. PATENT DOCUMENTS 6,084,378 A * 7/2000 Carobolante ..... H02P 25/034 318/254.2
7,898,511 B2 * 3/2011 Yoo ..... G09G 3/3233 345/204
9,349,439 B2 * 5/2016 Yamamoto ..... G11C 11/419
9,548,020 B2 * 1/2017 Kim ..... G09G 3/3233
2006/0158926 A1 * 7/2006 Yokoyama ..... H01L 27/1104 365/154
2012/0257309 A1 * 10/2012 Mizukami ..... H02H 7/008 361/18
2013/0175941 A1 7/2013 Wu et al.
2014/0168190 A1 6/2014 Kwak et al.
2016/0036399 A1 * 2/2016 McCune, Jr. ..... H03F 3/2171 455/114.3

FOREIGN PATENT DOCUMENTS

| | | |
|---|---|---|
| CN | 102982766 | 3/2013 |
| CN | 104064139 | 9/2014 |
| CN | 203812537 | 9/2014 |
| CN | 104167180 | 11/2014 |
| CN | 104658481 | 5/2015 |
| EP | 2237253 | 10/2010 |
| EP | 2608192 | 6/2013 |

OTHER PUBLICATIONS

Office action from Chinese Application No. 201510106650.6 dated Jul. 18, 2016.

* cited by examiner

PIXEL COMPENSATION CIRCUIT, DISPLAY DEVICE AND DRIVING METHOD

RELATED APPLICATIONS

The present application is the U.S. national phase entry of PCT/CN2015/087620, with an international filling date of Aug. 20, 2015, which claims the benefit of Chinese Patent Application No. 201510106550.6, filed on Mar. 11, 2015, the entire disclosure of which are incorporated herein by reference

FIELD OF THE INVENTION

The present invention relates to the display technical field, particularly to a pixel compensation circuit, display device and driving method.

BACKGROUND OF THE INVENTION

The active matrix organic light emitting diode display (AMOIED) has been widely used due to the advantages such as wide viewing angle, good color contrast effect, fast response speed and self illumination.

AMOIED primarily employs low temperature poly-silicon as the driving layer to enable its pixel driving circuit. Compared to the general amorphous silicon technology, the low-temperature poly-silicon thin film transistor is characterized by higher mobility and better stability, which is more suitable for AMOLED display.

However, due to the characteristics of the backplate process and poly-silicon, the low-temperature poly-silicon backplate inevitably leads to difference in threshold voltages of the very close transistors. This would cause the display brightness of different pixels to be different when they receive the same data signal, thereby resulting in non-uniform display of the display panel.

SUMMARY OF THE INVENTION

This summary is provided to introduce a selection of concepts in a simplified form that are further described below in the detailed description. The summary of the invention neither intends to mark key features or essential features of the claimed subject matters, nor intends to be used for limiting the scopes of the claimed subject matters. In addition, the claimed subject matters are not limited to the embodiments which have solved any or all defects mentioned in any part of the present disclosure.

The embodiments of the present invention provide a pixel compensation circuit, display device and driving method for solving the problem of non-uniform display of the display panel resulting from the difference in threshold voltages of the transistors on the low-temperature poly-silicon backplate.

Based on the above problem, the pixel compensation circuit provided by the embodiments of the present invention comprises a driving signal generation module, a data line loading module, a voltage loading module, an organic light-emitting diode and a driving transistor. The data signal loading module is capable of receiving a data signal and a scanning signal and is used for loading the data signal to a gate of the driving transistor when the scanning signal is a turn-on signal. The voltage loading module is at least capable of receiving a first voltage signal and a second luminescent signal and is used for loading the first voltage signal to a source of the driving transistor when a first luminescent signal and the scanning signal are both turn-on signals, wherein a voltage of the first voltage signal is higher than a voltage of the data signal, and a voltage of the first voltage signal is higher than a voltage of a second voltage signal which is received by the cathode of the organic light-emitting diode. The driving signal generation module is capable of receiving the first luminescent signal and a third voltage signal and is used for storing a signal of the source of the driving transistor, a signal of the gate of the driving transistor and the third voltage signal; and storing the data signal when the first luminescent signal and the scanning signal are both turn-on signals; and generating the signal of the source of the driving transistor according to the signal of the gate of the driving transistor when the first luminescent signal is a turn-off signal, the scanning signal is a turn-on signal and the voltage loading module stops loading a signal to the source of the driving transistor; and receiving the voltage signal loaded by the voltage loading module to the source of the driving transistor when the scanning signal and the first luminescent signal are both turn-off signals, and the second luminescent signal is a turn-on signal; and generating a driving signal according to the signal of the source of the driving transistor and the signal of the gate of the driving transistor when the scanning signal is a turn-off signal, and the first luminescent signal and the second luminescent signal are both turn-on signals, wherein the driving signal is used for driving the organic light-emitting diode to emit light.

The display device provided by the embodiments of the present invention comprises the pixel compensation circuit provided by the embodiments of the present invention.

The driving method provided by the embodiments of the present invention is applied in the pixel compensation circuit provided by the embodiments of the present invention. The method comprises: the data signal loading module loading the data signal to a gate of the driving transistor when the scanning signal is a turn-on signal; the voltage loading module loading the first voltage signal to a source of the driving transistor when the first luminescent signal and the scanning signal are both turn-on signals, wherein a voltage of the first voltage signal is higher than a voltage of the data signal, and a voltage of the first voltage signal is higher than a voltage of a second voltage signal which is received by the cathode of the organic light-emitting diode; the driving signal generation module storing a signal of the source of the driving transistor, a signal of the gate of the driving transistor and the third voltage signal; and storing the data signal when the first luminescent signal and the scanning signal are both turn-on signals; and generating the signal of the source of the driving transistor according to the signal of the gate of the driving transistor when the first luminescent signal is a turn-off signal, the scanning signal is a turn-on signal and the voltage loading module stops loading a signal to the source of the driving transistor; and receiving the voltage signal loaded by the voltage loading module to the source of the driving transistor when the scanning signal and the first luminescent signal are both turn-off signals, and the second luminescent signal is a turn-on signal; and generating a driving signal according to the signal of the source of the driving transistor and the signal of the gate of the driving transistor when the scanning signal is a turn-off signal, and the first luminescent signal and the second luminescent signal are both turn-on signals, wherein the driving signal is used for driving the organic light-emitting diode to emit light.

The beneficial effects of the embodiments of the present invention include: in the pixel compensation circuit, display device and driving method provided by the embodiments of the present invention, the driving signal generation module is capable of generating a signal of the source of the driving transistor according to the signal of the gate of the driving transistor when the first luminescent signal is a turn-off signal, the scanning signal is a turn-on signal and the voltage loading module stops loading a signal to the source of the driving transistor, the signal of the source of the driving transistor being correlated with the threshold voltage, and generating a driving signal according to the signal of the source of the driving transistor and the signal of the gate of the driving transistor when the scanning signal is a turn-off signal, and the first luminescent signal and the second luminescent signal are both turn-on signals; the driving transistor generates a drain current according to the driving signal to drive the organic light-emitting diode to emit light. This can reduce impact of the difference in threshold voltages of the driving transistor on the drain current of the driving transistor to thereby reduce non-uniformity of display of the display panel resulting from the difference in threshold voltages.

DETAILED DESCRIPTION OF THE INVENTION

The transistor in the pixel compensation circuit provided by the embodiments of the present invention may be a p-type transistor and may also be an n-type transistor. When the transistor in the pixel compensation circuit is a p-type transistor, the turn-on signal is a low level signal, and the turn-off signal is a high level signal. When the transistor in the pixel compensation circuit is an n-type transistor, the turn-on signal is a high level signal, and the turn-off signal is a low level signal. Regardless of whether the transistor in the pixel compensation circuit is a p-type transistor or an n-type transistor, the circuit logic of the pixel compensation circuit is the same. Therefore, the following explanation is made only taking the case in which the transistor in the pixel compensation circuit is a p-type transistor as an example. The operational principle of the pixel compensation circuit consisting of the n-type transistor is similar to that of the pixel compensation circuit consisting of the p-type transistor, unnecessary details of which are not given here.

As for a transistor in the liquid crystal display field, a drain and a source do not have definite difference. Therefore, a first pole of the transistor mentioned in the embodiments of the present invention may be a source (or drain) of the transistor, and a second pole of the transistor may be a drain (or source) of the transistor. If the source of the transistor is the first pole, the drain of transistor is the second pole. If the drain of the transistor is the first pole, the source of the transistor is the second pole.

Specific implementations of the pixel compensation circuit, display device and driving method provided by the embodiments of the present invention are explained as follows in combination with the figures.

The embodiments of the present invention provide a pixel compensation circuit. According to the embodiment of FIG. 1 or FIG. 2, the pixel compensation circuit as shown comprises a data signal loading module 11, a voltage loading module 12, a driving signal generation module 13, an organic light-emitting diode D and a driving transistor Td.

Figure 1:
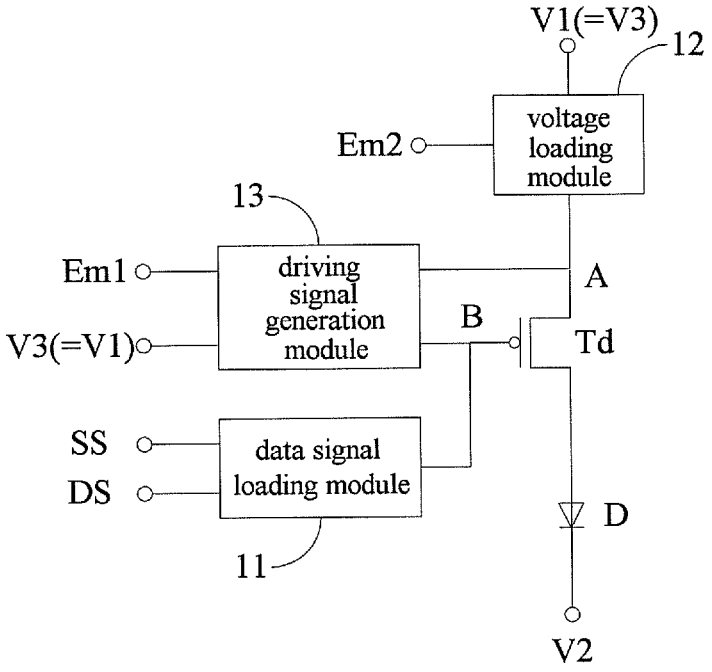
FIG. 1 is a first structural schematic diagram of a pixel compensation circuit provided by the embodiments of the present invention.
Figure 2:
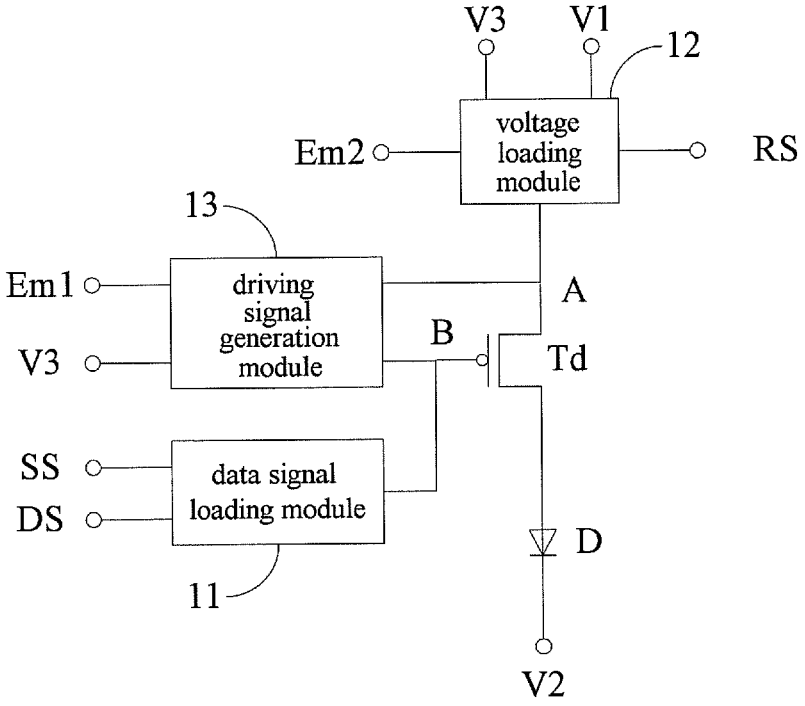
FIG. 2 is a second structural schematic diagram of a pixel compensation circuit provided by the embodiments of the present invention.

According to the embodiment of FIG. 1 or FIG. 2, the data signal loading module 11 is configured to be inputted with a scanning signal SS and a data signal DS, and connected to a gate of the driving transistor Td. The data signal loading module 11 is used for loading the data signal DS to the gate of the driving transistor Td when the scanning signal SS is a turn-on signal.

According to the embodiment of FIG. 1, the voltage loading module 12 is configured to be inputted with a second luminescent signal Em2 and a first voltage signal V1, and connected to a source of the driving transistor Td. The voltage loading module 12 is used for loading the first voltage signal V1 inputted to the voltage loading module 12 to the source of the driving transistor Td when a first luminescent signal Em1 inputted to the driving signal generation module 13 and the scanning signal SS inputted to the data signal loading module 11 are both turn-on signals, wherein the voltage of the first voltage signal V1 is higher than the voltage of the data signal DS inputted to the data signal loading module 11, and the voltage of the first voltage signal V1 is higher than the voltage of the second voltage signal V2 received by the cathode of the organic light-emitting diode D; and loading the first voltage signal V1 inputted to the voltage loading module to the source of the driving transistor Td when the second luminescent signal Em2 is a turn-on signal, and the first luminescent signal EM1 and the scanning signal SS are both turn-off signals, wherein the second luminescent signal EM2 is also maintained as a turn-on signal when the first luminescent signal Em1 and the scanning signal SS are both turn-on signals.

According to the embodiment of FIG. 2, the voltage loading module 12 is configured to be inputted with the second luminescent signal Em2, a reset signal RS, the first voltage signal V1 and a third voltage signal V3, and connected to the source of the driving transistor Td. The voltage loading module 12 is used for loading the first voltage signal V1 inputted to the voltage loading module 12 to the source of the driving transistor Td when the first luminescent signal Em1 inputted to the driving signal generation module 13 and the scanning signal SS inputted to the data signal loading module 11 are both turn-on signals and the second luminescent signal Em2 is a turn-off signal, wherein the voltage of the first voltage signal V1 is higher than the voltage of the data signal DS inputted to the data signal loading module 11, and the voltage of the first voltage signal V1 is higher than the voltage of the second voltage signal V2 received by the cathode of the organic light-emitting diode D; and loading the third voltage signal V3 to the source of the driving transistor Td when the second luminescent signal Em2 is a turn-on signal, and the scanning signal SS and the reset signal RS are both turn-off signals, wherein the first voltage signal V1 is different from the third voltage signal V3, and the reset signal RS is also maintained as a turn-on signal when the first luminescent signal Em1 and the scanning signal SS are both turn-on signals.

According to the embodiment of FIG. 1 or FIG. 2, the driving signal generation module 13 is configured to be inputted with the first luminescent signal Em1 and the third voltage signal V3, and connected to the gate and the source of the driving transistor Td. The driving signal generation module 13 is used for storing a signal of the source of the driving transistor Td, a signal of the gate of the driving transistor Td and the third voltage signal V3; and storing the data signal DS when the first luminescent signal Em1 and the scanning signal SS are both turn-on signals; and generating the signal of the source of the driving transistor Td according to the signal of the gate of the driving transistor Td when the first luminescent signal Em1 is a turn-off signal, the scanning signal SS is a turn-on signal and the voltage loading module 12 stops loading a signal to the source of the driving transistor Td, wherein, it is well-known to those skilled in the art that the signal of the source of the driving transistor Td is correlated with a threshold voltage Vth of the driving transistor Td; and receiving the voltage signal (it is V1 in FIG. 1 and V3 in FIG. 2) loaded by the voltage loading module 12 to the driving transistor Td when the scanning signal SS and the first luminescent signal Em1 are both turn-off signals, and the second luminescent signal Em2 is a turn-on signal; and generating a driving signal according to the signal of the source of the driving transistor Td and the signal of the gate of the driving transistor Td when the scanning signal SS is a turn-off signal, and the first luminescent signal Em1 and the second luminescent signal Em2 are both turn-on signals (if there is a reset signal, the reset signal is a turn-off signal), wherein the driving signal is used for driving the organic light-emitting diode D to emit light.

Figure 3:
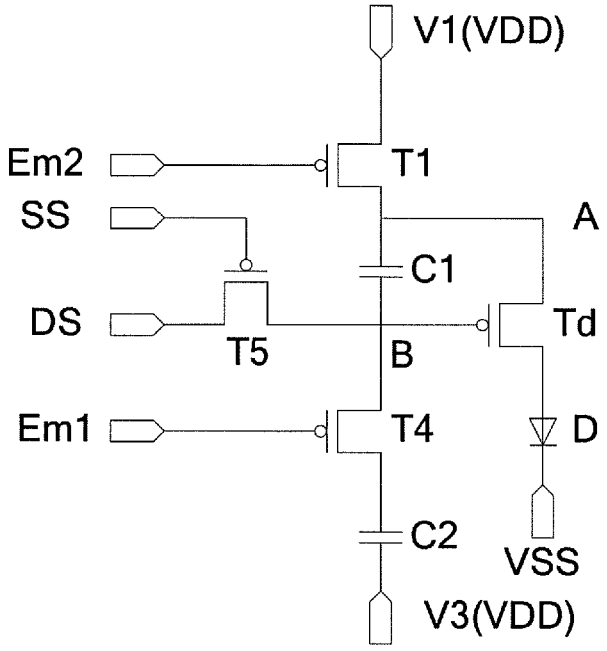
FIG. 3 is a third structural schematic diagram of a pixel compensation circuit provided by the embodiments of the present invention.

The pixel compensation circuit shown in FIG. 1 is further shown in FIG. 3. Alternatively or optionally, the driving signal generation module 13 comprises a first capacitance C1, a second capacitance C2 and a fourth transistor T4. The first capacitance C1 is connected between the source of the driving transistor Td and the gate of the driving transistor Td. A gate of the fourth transistor T4 receives the first luminescent signal Em1, a first pole of the fourth transistor T4 is connected to the gate of the driving transistor Td, and a second pole of the fourth transistor T4 receives the third voltage signal V3 via the second capacitance C2. In FIGS. 1 and 3, the first voltage signal V1 is identical with the third voltage signal V3, both of which are shown in FIG. 3 as signal VDD. Alternatively or optionally, the voltage loading module comprises a first transistor T1. A gate of the first transistor T1 receives the second luminescent signal Em2, a first pole of the first transistor T1 receives the first voltage signal V1, and a second pole of the first transistor T1 is connected to the source of the driving transistor Td. Alternatively or optionally, the data signal loading module 11 comprises a fifth transistor T5. A gate of the fifth transistor T5 receives the scanning signal SS, a first pole of the fifth transistor T5 receives the data signal DS, and a second pole of the fifth transistor T5 is connected to the gate of the driving transistor Td.

Figure 4:
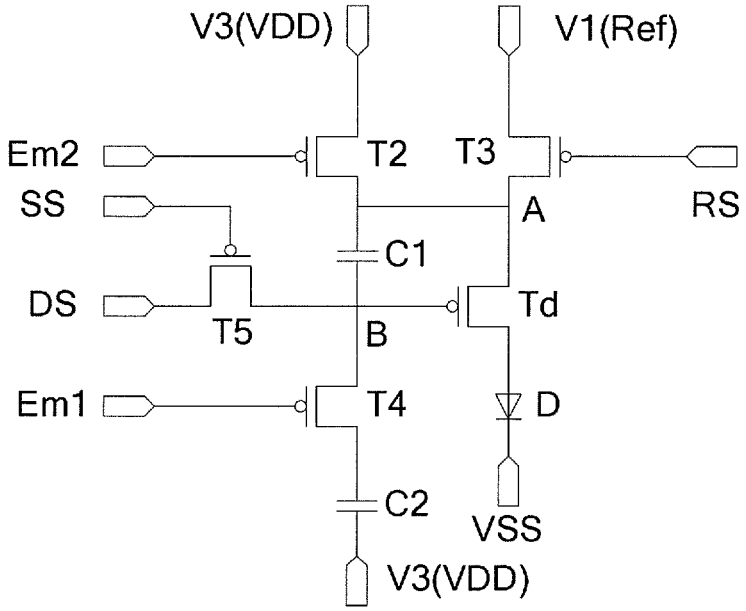
FIG. 4 is a fourth structural schematic diagram of a pixel compensation circuit provided by the embodiments of the present invention.

The pixel compensation circuit shown in FIG. 2 is further shown in FIG. 4. Alternatively or optionally, the driving signal generation module 13, like the one shown in FIG. 3, comprises a first capacitance C1, a second capacitance C2 and a fourth transistor T4. The first capacitance C1 is connected between the source of the driving transistor Td and the gate of the driving transistor Td. A gate of the fourth transistor T4 receives the first luminescent signal Em1, a first pole of the fourth transistor T4 is connected to the gate of the driving transistor Td, and a second pole of the fourth transistor T4 receives the third voltage signal V3 via the second capacitance C2. Alternatively or optionally, the voltage loading module 12 comprises a second transistor T2 and a third transistor T3. A gate of the second transistor T2 receives the second luminescent signal Em2, a first pole of the second transistor T2 receives the third voltage signal V3, and a second pole of the second transistor T2 is connected to the source of the driving transistor Td. A gate of the third transistor T3 receives the reset signal RS, a first pole of the third transistor T3 receives the first voltage signal V1, and a second pole of the third transistor T3 is connected to the source of the driving transistor Td. At that time, the first voltage signal V1 is different from the third voltage signal V3. The first voltage signal V1 is a reference signal Ref, and the third voltage signal V3 is a signal VDD. Alternatively or optionally, the data signal loading module 11, like the one shown in FIG. 3, a fifth transistor T5. A gate of the fifth transistor T5 receives the scanning signal SS, a first pole of the fifth transistor T5 receives the data signal DS, and a second pole of the fifth transistor T5 is connected to the gate of the driving transistor Td.

Figure 5:
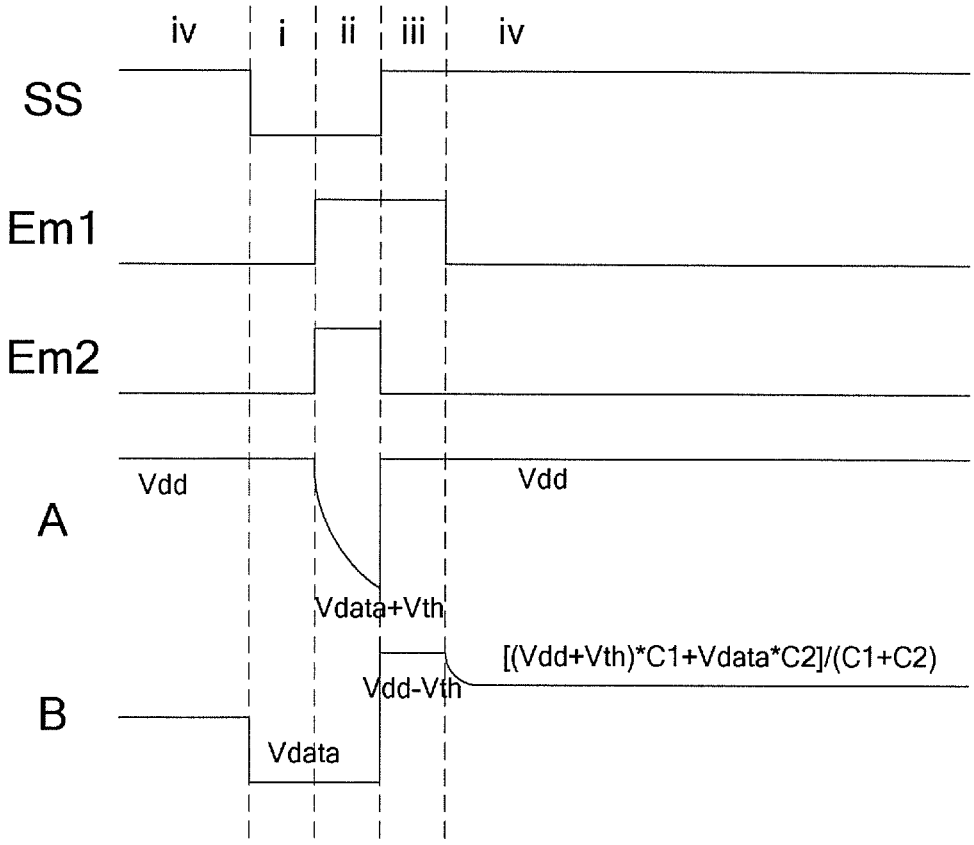
FIG. 5 is a working time sequential diagram of the pixel compensation circuit shown in FIG. 3.

FIG. 5 shows a working time sequence of the pixel compensation circuit shown in FIG. 3. In FIG. 5, the turn-on signal is a low level signal and the turn-off signal is a high level signal.

In FIG. 5, when the first luminescent signal Em1, the second luminescent signal Em2 and the scanning signal SS are all turn-on signals, i.e., in a time period i, the signal of the gate of the driving transistor Td, i.e., signal of point B, is the data signal DS and the driving signal generation module 13 would store the data signal DS, and the signal of the source of the driving transistor Td, i.e., signal of point A, is VDD. When the first luminescent signal Em1 is a turn-off signal, the scanning signal SS is a turn-on signal and the voltage loading module 12 stops loading a signal to the source of the driving transistor Td, i.e., in a time period ii, since the voltage of the source of the driving transistor Td after just entering the time period ii is the voltage Vdd of the signal VDD, which is higher than the voltage Vdata of the data signal DS and higher than the voltage of the second voltage signal V2 received by the cathode of the organic light-emitting diode D, the driving transistor Td and the organic light-emitting diode D constitute a discharge channel until the voltage of the source of the driving transistor Td, i.e., voltage of point A, decreases to Vdata+Vth. Since the scanning signal SS is a turn-on signal, the voltage of the gate of the driving transistor Td, i.e., voltage of point B, is still Vdata. When the scanning signal SS and the first luminescent signal Em1 are both turn-off signals, and the second luminescent signal Em2 is a turn-on signal, i.e., in a time period iii, since the signal VDD loaded by the voltage loading module 12 to the source of the driving transistor Td is received, the voltage of point A changes from Vdata+Vth to Vdd. Since the driving signal generation module 13 is used for storing the capacitances of the signal of the source of the driving transistor Td (i.e., signal of point A) and the signal of the gate of the driving transistor Td (i.e., signal of point B), i.e., coupling effect of the first capacitance C1, the voltage of point B changes from Vdata to Vdd-Vth. When the scanning signal SS is a turn-off signal, and the first luminescent signal Em1 and the second luminescent signal Em2 are both turn-on signals, i.e., in a time period iv, since the fourth transistor T4 is conducting, the plates of the first capacitance C1 and the second capacitance C2 are connected and charges would flow therebetween. In accordance with the law of conservation of charge, the electric potential Vb of point B is:

$$Vb = Vdd\ \frac{Vth*C1+(Vdd\ Vdata)*C2}{C1+C2} = \frac{Vdd*C1+Vth*C1+Vdata*C2}{C1+C2},$$

at that time, the signal of point B is namely the driving signal. The driving transistor Td would generate a drain current Id according to the signal of point A, i.e., signal VDD, and the signal of point B, so as to drive the organic light-emitting diode D to emit light, wherein Id is:

$$Id = K\times\left(\frac{C2}{C1+C2}\right)^2\times(Vdd+Vth-Vdata),$$

wherein K is a constant correlated with the structural parameters of the driving transistor. Since Vdd and Vth are both relatively determined, it is required to adjust the value of Vdata in order to reach the desired drain current. The same current interval corresponds to an increased Vdata range. Meanwhile, due to the increase in the Vdata range, the impact of the respective fluctuation in Vth and Vdd on the final drain current Id would correspondingly become smaller, thereby realizing the effect of partially compensating Vdd and Vth, i.e., realizing the effect of partially compensating the threshold voltage deviation.

Since in some cases the voltage Vdata of the data signal DS may be higher than Vdd, in order to ensure that the driving transistor Td can be conducting to thereby constitute a discharge channel to read the threshold voltage of the driving transistor, the embodiments of the present invention provide another pixel compensation circuit. The pixel compensation circuit shown in FIG. 4 is to load a reference signal Ref when the first luminescent signal Em1 and the scanning signal SS are both turn-on signals. The voltage Vref of the reference signal Ref may be set to be high enough to thereby ensure that when the first luminescent signal Em1 is a turn-off signal, the scanning signal SS is a turn-on signal and the voltage loading module 12 stops loading a signal to the source of the driving transistor Td, the driving transistor Td can be conducting to constitute a discharge channel to read the threshold voltage of the driving transistor.

Figure 6:
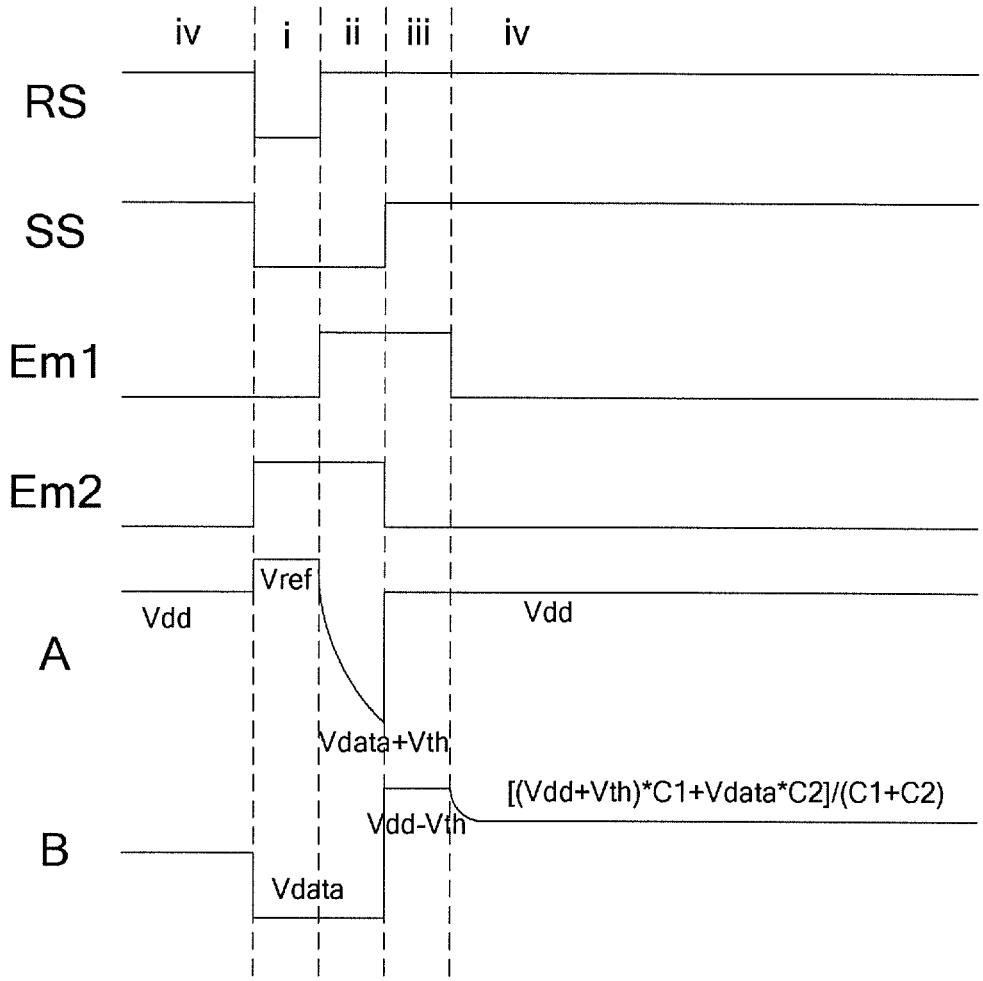
FIG. 6 is a working time sequential diagram of the pixel compensation circuit shown in FIG. 4.

FIG. 6 shows a working time sequence of the pixel compensation circuit shown in FIG. 4. In FIG. 6, the turn-on signal is a low level signal and the turn-off signal is a high level signal.

In FIG. 6, when the first luminescent signal Em1 and the scanning signal SS are both turn-on signals, i.e., in a time period i, the reset signal RS is a turn-on signal, and the second luminescent signal Em2 is a turn-off signal, the signal of the gate of the driving transistor Td, i.e., signal of point B, is the data signal DS and the driving signal generation module would store the data signal DS, and the signal of the source of the driving transistor Td, i.e., signal of point A, is Vref. When the first luminescent signal Em1 is a turn-off signal, the scanning signal SS is a turn-on signal and the voltage loading module 12 stops loading a signal to the source of the driving transistor Td, i.e., in a time period ii, since the voltage of the signal of the source of the driving transistor Td, i.e. voltage of the reference signal Ref, is higher than the voltage Vdata of the data signal DS and higher than the voltage of the second voltage signal V2 received by the cathode of the organic light-emitting diode D, the driving transistor Td and the organic light-emitting diode D constitute a discharge channel until the voltage of the source of the driving transistor Td, i.e., voltage of point A, decreases to Vdata+Vth. Since the scanning signal SS is a turn-on signal, the voltage of the gate of the driving transistor Td, i.e., voltage of point B, is still Vdata. When the scanning signal SS and the first luminescent signal Em1 are both turn-off signals, the second luminescent signal Em2 is a turn-on signal, and RS is a turn-off signal, i.e., in a time period iii, since the signal VDD loaded by the voltage loading module 12 to the source of the driving transistor Td is received, the voltage of point A changes from Vdata+Vth to Vdd. Since the driving signal generation module 13 is used for storing the capacitances of the signal of the source of the driving transistor Td (i.e., signal of point A) and the signal of the gate of the driving transistor Td (i.e., signal of point B), i.e., coupling effect of the first capacitance C1, the voltage of point B changes from Vdata to Vdd-Vth. When the scanning signal SS is a turn-off signal, and the first luminescent signal Em1 and the second luminescent signal Em2 are both turn-on signals, i.e., in a time period iv, since the fourth transistor T4 is conducting, the plates of the first capacitance C1 and the second capacitance C2 are connected and charges would flow therebetween. In accordance with the law of conservation of charge, the electric potential Vb of point B is:

$$Vb = Vdd\ \frac{-Vth*C1+(Vdd-Vdata)*C2}{C1+C2} = \frac{Vdd*C1+Vth*C1+Vdata*C2}{C1+C2},$$

at that time, the signal of point B is namely the driving signal. The driving transistor Td would generate a drain current Id according to the signal of point A, i.e., signal VDD, and the signal of point B, so as to drive the organic light-emitting diode D to emit light, wherein Id is:

$$Id = K\times\left(\frac{C2}{C1+C2}\right)^2\times(Vdd+Vth-Vdata),$$

wherein K is a constant correlated with the structural parameters of the driving transistor. Since Vdd and Vth are both relatively determined, it is required to adjust the value of Vdata in order to reach the desired drain current. The same current interval corresponds to an increased Vdata range. Meanwhile, due to the increase in the Vdata range, the impact of the respective fluctuation in Vth and Vdd on the final drain current Id would correspondingly become smaller, thereby realizing the effect of partially compensating Vdd and Vth, i.e., realizing the effect of partially compensating the threshold voltage deviation.

It is noted that the data signal of each frame may be different (Vdata is different), therefore, in FIGS. 5 and 6 the stabilized voltage value of point B in the fourth time sequence of the previous frame may be different from the stabilized voltage value of point B in the fourth time sequence of the current frame. According to the working time sequence shown in FIG. 5 or FIG. 6, display of the display signal is effected.

The embodiments of the present invention provide a display device comprising the pixel compensation circuit provided by any embodiment of the present invention.

The embodiments of the present invention provide a driving method which is applied in the pixel compensation circuit provided by the embodiments of the present invention. The method comprises: the data signal loading module loading the data signal to a gate of the driving transistor when the scanning signal is a turn-on signal; the voltage loading module loading the first voltage signal to a source of the driving transistor when the first luminescent signal and the scanning signal are both turn-on signals, wherein a voltage of the first voltage signal is higher than a voltage of the data signal, and a voltage of the first voltage signal is higher than a voltage of a second voltage signal which is received by the cathode of the organic light-emitting diode; the driving signal generation module storing a signal of the source of the driving transistor, a signal of the gate of the driving transistor and the third voltage signal; and storing the data signal when the first luminescent signal and the scanning signal are both turn-on signals; and generating the signal of the source of the driving transistor according to the signal of the gate of the driving transistor when the first luminescent signal is a turn-off signal, the scanning signal is a turn-on signal and the voltage loading module stops loading a signal to the source of the driving transistor; and receiving the voltage signal loaded by the voltage loading module to the source of the driving transistor when the scanning signal and the first luminescent signal are both turn-off signals, and the second luminescent signal is a turn-on signal; and generating a driving signal according to the signal of the source of the driving transistor and the signal of the gate of the driving transistor when the scanning signal is a turn-off signal, and the first luminescent signal and the second luminescent signal are both turn-on signals, wherein the driving signal is used for driving the organic light-emitting diode to emit light.

Alternatively or optionally, the first voltage signal is identical with the third voltage signal. When the first luminescent signal and the scanning signal are both turn-on signals, the second luminescent signal is a turn-on signal; the voltage loading module thereby loads the first voltage signal to the gate of the driving transistor.

Alternatively or optionally, the first voltage signal is different from the third voltage signal. The voltage loading module further receives the reset signal and the third voltage signal. When the first luminescent signal and the scanning signal are both turn-on signals, the reset signal is a turn-on signal, the voltage loading module thereby loads the first voltage signal to the gate of the driving transistor; and when the scanning signal and the first luminescent signal are both turn-off signals and the second luminescent signal is a turn-on signal, the voltage loading module loads the third voltage signal to the gate of the driving transistor.

Those skilled in the art can understand that a figure is just a schematic diagram of one preferred embodiment. A module or flow in the figure is not necessarily essential for implementing the present invention.

Those skilled in the art can understand that the modules in the device of the embodiment can be distributed in the device of the embodiment according to the description of the embodiment, and can also be correspondingly changed and located in one or more devices different from the present embodiment. The modules in the above embodiment can be integrated into one module and can also be further split into a plurality of sub-modules.

The sequence numbers of the embodiments of the present invention are only for description, regardless of superiority and inferiority.

Obviously, those skilled in the art can make various modifications and variations to the present invention without departing from the spirit and scope thereof. In this way, if these modifications and variations to the present invention pertain to the scopes of the claims of the present invention and equivalent techniques thereof, the present invention also intends to include these modifications and variations.

The invention claimed is:

1. A pixel compensation circuit, comprising:

a driving signal generation module;

a data line loading module;

a voltage loading module, an organic light-emitting diode; and a driving transistor, wherein:

said data line loading module is capable of receiving a data signal and a scanning signal and is used for loading said data signal to a gate of said driving transistor when said scanning signal is a turn-on signal;

said voltage loading module is capable of receiving a first voltage signal and a second luminescent signal and is used for loading said first voltage signal to a source of said driving transistor when a first luminescent signal and said scanning signal are both turn-on signals, wherein a voltage of said first voltage signal is higher than a voltage of said data signal, a voltage of said first voltage signal is higher than a voltage of a second voltage signal which is received by a cathode of said organic light-emitting diode;

said driving signal generation module is capable of receiving the first luminescent signal and a third voltage signal and is used for storing a signal of the source of said driving transistor, a signal of the gate of said driving transistor and said third voltage signal, and executing the following steps:

storing said data signal when said first luminescent signal and said scanning signal are both turn-on signals;

generating the signal of the source of said driving transistor according to the signal of the gate of said driving transistor when said first luminescent signal is a turn-off signal, said scanning signal is a turn-on signal and said voltage loading module stops loading a signal to the source of said driving transistor;

receiving the voltage signal loaded by said voltage loading module to the source of said driving transistor when said scanning signal and said first luminescent signal are both turn-off signals, and said second luminescent signal is a turn-on signal; and generating a driving signal according to the signal of the source of said driving transistor and the signal of the gate of said driving transistor when said scanning signal is a turn-off signal, and said first luminescent signal and said second luminescent signal are both turn-on signals, said driving signal being used for driving said organic light-emitting diode to emit light.

2. The pixel compensation circuit according to claim 1, wherein said first voltage signal is identical with said third voltage signal; and when said first luminescent signal and said scanning signal are both turn-on signals, said second luminescent signal is also a turn-on signal, such that said voltage loading module loads said first voltage signal to the gate of said driving transistor.

3. The pixel compensation circuit according to claim 2, wherein said voltage loading module comprises a first transistor;

a gate of said first transistor receives said second luminescent signal, a first pole of said first transistor receives said first voltage signal, a second pole of said first transistor is connected to the source of said driving transistor.

4. The pixel compensation circuit according to claim 1, wherein said first voltage signal is different from said third voltage signal; said voltage loading module further receives a reset signal and said third voltage signal; when said first luminescent signal and said scanning signal are both turn-on signals, said reset signal is also a turn-on signal, such that said voltage loading module loads said first voltage signal to the gate of said driving transistor; and when said scanning signal and said first luminescent signal are both turn-off signals and said second luminescent signal is a turn-on signal, said voltage loading module loads said third voltage signal to the gate of said driving transistor.

5. The pixel compensation circuit according to claim 4, wherein said voltage loading module comprises a second transistor and a third transistor;

a gate of said second transistor receives said second luminescent signal, a first pole of said second transistor receives said third voltage signal, a second pole of said second transistor is connected to the source of said driving transistor;

a gate of said third transistor receives said reset luminescent signal, a first pole of said third transistor receives said first voltage signal, a second pole of said third transistor is connected to the source of said driving transistor;

wherein, when said second luminescent signal is a turn-on signal, said third voltage signal is loaded to the source of said driving transistor.

6. The pixel compensation circuit according to claim 1, wherein said driving signal generation module comprises a first capacitance, a second capacitance and a fourth transistor;

said first capacitance is connected between the source of said driving transistor and the gate of said driving transistor;

a gate of said fourth transistor receives said first luminescent signal, a first pole of said fourth transistor is connected to the gate of said driving transistor, a second pole of said fourth transistor receives said third voltage signal via said second capacitance.

7. The pixel compensation circuit according to claim 1, wherein said data signal loading module comprises a fifth transistor;

a gate of said fifth transistor receives said scanning signal, a first pole of said fifth transistor receives said data signal, a second pole of said fifth transistor is connected to the gate of said driving transistor.

8. The pixel compensation circuit according to claim 1, wherein said turn-on signal is a low level signal, said turn-off signal is a high level signal.

9. A driving method, the method being applied in the pixel compensation circuit according to claim 1, comprising:

said data signal loading module loading said data signal to a gate of said driving transistor when said scanning signal is a turn-on signal;

said voltage loading module loading said first voltage signal to a source of said driving transistor when said first luminescent signal and said scanning signal are both turn-on signals, wherein a voltage of said first voltage signal is higher than a voltage of said data signal, a voltage of said first voltage signal is higher than a voltage of a second voltage signal which is received by a cathode of said organic light-emitting diode;

said driving signal generation module storing a signal of the source of said driving transistor, a signal of the gate of said driving transistor and said third voltage signal, and executing the following steps:

storing said data signal when said first luminescent signal and said scanning signal are both turn-on signals;

generating the signal of the source of said driving transistor according to the signal of the gate of said driving transistor when said first luminescent signal is a turn-off signal, said scanning signal is a turn-on signal and said voltage loading module stops loading a signal to the source of said driving transistor;

receiving the voltage signal loaded by said voltage loading module to the source of said driving transistor when said scanning signal and said first luminescent signal are both turn-off signals, and said second luminescent signal is a turn-on signal; and generating a driving signal according to the signal of the source of said driving transistor and the signal of the gate of said driving transistor when said scanning signal is a turn-off signal, and said first luminescent signal and said second luminescent signal are both turn-on signals, said driving signal being used for driving said organic light-emitting diode to emit light.

10. The method according to claim 9, wherein said first voltage signal is identical with said third voltage signal; and when said first luminescent signal and said scanning signal are both turn-on signals, said second luminescent signal is also a turn-on signal, such that said voltage loading module loads said first voltage signal to the gate of said driving transistor.

11. The method according to claim 9, wherein said first voltage signal is different from said third voltage signal; said voltage loading module further receives a reset signal and said third voltage signal; when said first luminescent signal and said scanning signal are both turn-on signals, said reset signal is also a turn-on signal, such that said voltage loading module loads said first voltage signal to the gate of said driving transistor; and when said scanning signal and said first luminescent signal are both turn-off signals and said second luminescent signal is a turn-on signal, said voltage loading module loads said third voltage signal to the gate of said driving transistor.

12. A display device, comprising:

a pixel compensation circuit, the pixel compensation circuit comprising:

a driving signal generation module;

a data line loading module;

a voltage loading module;

an organic light-emitting diode and, a driving transistor, wherein:

said data signal loading module is capable of receiving a data signal and a scanning signal and is used for loading said data signal to a gate of said driving transistor when said scanning signal is a turn-on signal;

said voltage loading module is at least capable of receiving a first voltage signal and a second luminescent signal and is used for loading said first voltage signal to a source of said driving transistor when a first luminescent signal and said scanning signal are both turn-on signals, wherein a voltage of said first voltage signal is higher than a voltage of said data signal, a voltage of said first voltage signal is higher than a voltage of a second voltage signal which is received by a cathode of said organic light-emitting diode;

said driving signal generation module is capable of receiving the first luminescent signal and a third voltage signal and is used for storing a signal of the source of said driving transistor, a signal of the gate of said driving transistor and said third voltage signal, and executing the following steps:

storing said data signal when said first luminescent signal and said scanning signal are both turn-on signals;

generating the signal of the source of said driving transistor according to the signal of the gate of said driving transistor when said first luminescent signal is a turn-off signal, said scanning signal is a turn-on signal and said voltage loading module stops loading a signal to the source of said driving transistor;

receiving the voltage signal loaded by said voltage loading module to the source of said driving transistor when said scanning signal and said first luminescent signal are both turn-off signals, and said second luminescent signal is a turn-on signal; and generating a driving signal according to the signal of the source of said driving transistor and the signal of the gate of said driving transistor when said scanning signal is a turn-off signal, and said first luminescent signal and said second luminescent signal are both turn-on signals, said driving signal being used for driving said organic light-emitting diode to emit light.

13. The display device of claim 12, wherein said first voltage signal is identical with said third voltage signal; and when said first luminescent signal and said scanning signal are both turn-on signals, said second luminescent signal is also a turn-on signal, such that said voltage loading module loads said first voltage signal to the gate of said driving transistor.

14. The display device of claim 13, wherein said voltage loading module comprises a first transistor;

a gate of said first transistor receives said second luminescent signal, a first pole of said first transistor receives said first voltage signal, a second pole of said first transistor is connected to the source of said driving transistor.

15. The display device of claim 12, wherein said first voltage signal is different from said third voltage signal; said voltage loading module further receives a reset signal and said third voltage signal; when said first luminescent signal and said scanning signal are both turn-on signals, said reset signal is also a turn-on signal, such that said voltage loading module loads said first voltage signal to the gate of said driving transistor; and when said scanning signal and said first luminescent signal are both turn-off signals and said second luminescent signal is a turn-on signal, said voltage loading module loads said third voltage signal to the gate of said driving transistor.

16. The display device of claim 15, wherein said voltage loading module comprises a second transistor and a third transistor;

a gate of said second transistor receives said second luminescent signal, a first pole of said second transistor receives said third voltage signal, a second pole of said second transistor is connected to the source of said driving transistor;

a gate of said third transistor receives said reset luminescent signal, a first pole of said third transistor receives said first voltage signal, a second pole of said third transistor is connected to the source of said driving transistor;

wherein, when said second luminescent signal is a turn-on signal, said third voltage signal is loaded to the source of said driving transistor.

17. The display device of claim 12, wherein said driving signal generation module comprises a first capacitance, a second capacitance and a fourth transistor;

said first capacitance is connected between the source of said driving transistor and the gate of said driving transistor;

a gate of said fourth transistor receives said first luminescent signal, a first pole of said fourth transistor is connected to the gate of said driving transistor, a second pole of said fourth transistor receives said third voltage signal via said second capacitance.

18. The display device of claim 12, wherein said data signal loading module comprises a fifth transistor;

a gate of said fifth transistor receives said scanning signal, a first pole of said fifth transistor receives said data signal, a second pole of said fifth transistor is connected to the gate of said driving transistor.

19. The display device of claim 12, wherein said turn-on signal is a low level signal, said turn-off signal is a high level signal.

* * * * *